US008836191B2

(12) United States Patent
Adachi et al.

(10) Patent No.: US 8,836,191 B2
(45) Date of Patent: Sep. 16, 2014

(54) POWER GENERATION APPARATUS

(75) Inventors: Shigeto Adachi, Takasago (JP); Masayoshi Matsumura, Takasago (JP); Yutaka Narukawa, Takasago (JP); Kazuo Takahashi, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/566,197

(22) Filed: Aug. 3, 2012

(65) Prior Publication Data

US 2013/0049367 A1 Feb. 28, 2013

(30) Foreign Application Priority Data

Aug. 30, 2011 (JP) ..... 2011-187251

(51) Int. Cl.
*H02K 7/10* (2006.01)
*F04C 29/00* (2006.01)
*F01C 1/16* (2006.01)

(52) U.S. Cl.
CPC ..... *F01C 1/16* (2013.01); *F04C 29/0064* (2013.01)
USPC ..... 310/103; 290/2

(58) Field of Classification Search
USPC ..... 290/2; 60/643; 310/103
See application file for complete search history.

(56) References Cited

U.S. PATENT DOCUMENTS 2,603,678 A * 7/1952 Helmer ..... 310/103
2,707,863 A * 5/1955 Rhodes ..... 60/669
4,207,485 A * 6/1980 Silver ..... 310/104
4,277,707 A * 7/1981 Silver et al. ..... 310/104
5,204,572 A * 4/1993 Ferreira ..... 310/156.19
5,633,555 A * 5/1997 Ackermann et al. ..... 310/75 D
6,959,549 B2 * 11/2005 Tilston ..... 60/651
7,249,459 B2 7/2007 Hisanaga et al.
7,357,567 B2 * 4/2008 Terentiev ..... 366/273
8,446,060 B1 * 5/2013 Lugg ..... 310/156.22
2004/0250545 A1 12/2004 Tilston
2007/0007771 A1 * 1/2007 Biddle et al. ..... 290/7
2011/0057456 A1 * 3/2011 Atallah et al. ..... 290/1 C
2011/0079007 A1 * 4/2011 Gouko et al. ..... 60/531
2011/0173991 A1 * 7/2011 Dean et al. ..... 60/801
2013/0084164 A1 * 4/2013 Adachi et al. ..... 415/122.1

FOREIGN PATENT DOCUMENTS

GB 675379 A1 * 1/1950
GB 2457682 A * 8/2009
JP 52-36242 3/1977
JP 01-259767 10/1989

(Continued)

OTHER PUBLICATIONS

U.S. Appl. No. 13/616,963, filed Sep. 14, 2012, Adachi, et al.

(Continued)

*Primary Examiner* — Joseph Waks
(74) *Attorney, Agent, or Firm* — Oblon, Spivak, McClelland, Maier & Neustadt, L.L.P.

(57) ABSTRACT

A power generation apparatus includes a housing that contains a driving unit of the expander within a space enclosed by a partition wall, and a magnetic coupling that is divided between the inside and outside of the housing through the partition wall and that transmits the rotational driving force of the expander to the exterior of the housing. The magnetic coupling includes driving-side magnets and slave-side magnets, and first and second magnetic path formation members respectively magnetically connect the driving-side magnets and also the slave-side magnets.

6 Claims, 10 Drawing Sheets

(56) References Cited

FOREIGN PATENT DOCUMENTS

| | | | |
|---|---|---|---|
| JP | 02-055569 | | 2/1990 |
| JP | 2005-160277 | | 6/2005 |
| JP | 2009-185772 | | 8/2009 |
| JP | 2011-122568 | | 6/2011 |
| KR | 10-0955235 | | 4/2010 |
| SU | 1113869 | A * | 9/1984 |
| SU | 1206560 | A * | 1/1986 |

OTHER PUBLICATIONS

Korean Office Action issued Aug. 26, 2013, in Korea Patent Application No. 10-2012-94725 (with English translation).

* cited by examiner

POWER GENERATION APPARATUS

BACKGROUND OF THE INVENTION

1. Field of the Invention

The present invention relates to power generation apparatuses that extract power generated by a thermal engine to the exterior of the thermal engine.

2. Description of the Related Art

Among thermal engines, external combustion engines are configured to convert heat into power (convert heat energy into kinetic energy) by expanding and condensing a working medium (also referred to as a working fluid), such as water or a low-boiling point medium (a medium having a lower boiling point than water) such as ammonia, pentane, Freon, or the like, through a thermodynamic cycle such as a Rankine cycle. Such a thermal engine includes an expander that expands working medium vapor, and the expander is contained within a housing that is separated from the exterior in an airtight state. Rotational driving force obtained through this expander is extracted to the exterior of the housing in which the expander is contained via a shaft, and is used to rotate a rotating machine such as a compressor, a blower, a pump, an electric generator, or the like.

For example, JP-2009-185772A discloses a fluid machine, including an expanding mechanism that generates rotational force by expanding a working fluid, an electric generator driven by the rotational force of the expanding mechanism, and a pump mechanism driven by the rotational force of the expanding mechanism, in which the fluid machine is configured so that the volume of the pump mechanism is variable.

Meanwhile, U.S. Pat. No. 7,249,459 discloses a fluid machine including an expander that converts heat energy from a Rankine cycle into rotational power, a liquid supply pump that is driven by the rotational power and increases the pressure in the Rankine cycle, and a motor that generates rotational driving force, in which a rotating shaft is shared by these elements.

These apparatuses (fluid machines) both contain an expander, which is part of a thermal engine, and a rotating machine such as an electric generator or a pump together within a single housing.

Incidentally, with the apparatuses (fluid machines) disclosed in the aforementioned background art, it is absolutely necessary to provide a seal in the housing that contains the expander in order to prevent the working medium from leaking.

In the case where an expander and a rotating machine such as an electric generator or a pump are contained within a single housing, as disclosed in JP-2009-185772A, there are situations where a shaft seal for a shaft that connects the expander and the rotating machine is not needed. However, specialized components are required for the housing or the rotating machine, which poses a problem in that generic components cannot be used. This can also easily lead to an increase in the initial costs of the power generation apparatus or electricity generation equipment that uses the power generation apparatus.

On the other hand, in the case where a rotational shaft for transmitting power passes through the housing and protrudes to the exterior, as shown in U.S. Pat. No. 7,249,459, a seal for the shaft is important particularly in binary electric generation, in which a low-boiling point medium, which should not be exposed to the atmosphere, is used as the working medium. With the equipment shown in U.S. Pat. No. 7,249,459, a structure is employed in which a shaft seal is provided between a rotary machine (a motor 9) and an expander, and thus the working medium does not leak toward the rotary machine. However, it is difficult to prevent the working medium from leaking with certainty even if this type of shaft seal is employed, and it is also necessary to carry out complicated maintenance procedures on the shaft seal. Further, this can easily lead to an increase in the running costs of the power generation apparatus or electricity generation equipment that uses the power generation apparatus.

Having been achieved in light of the stated problems, it is an object of the present invention to provide a power generation apparatus capable of efficiently transmitting rotational driving force generated by an expander to the exterior of a housing that contains the expander while preventing a working medium from leaking, even when the thermal engine and a rotary machine are not contained together within a single housing, or when a shaft sealing mechanism is not employed on a shaft that transmits power.

SUMMARY OF THE INVENTION

In order to achieve the above object, a power generation apparatus according to the present invention includes the following technical means. That is, the power generation apparatus according to the present invention includes a thermal engine including an expander, a housing that contains the expander, and a power transmission shaft that extracts rotational driving force generated by the expander to the exterior of the housing that contains a driving unit of the expander, in which the housing includes a partition wall, the expander is contained within a space enclosed by the partition wall, and the power transmission shaft includes a magnetic coupling for transmitting the rotational driving force from the expander to the exterior of the housing, that is divided between the interior and exterior of the housing through the partition wall.

An electric generator that generates electricity using the rotational driving force transmitted to the exterior of the housing may be connected to the power transmission shaft on the outside of the housing.

Preferably, the magnetic coupling includes a driving-side magnet that rotates on the inside of the housing due to the rotational driving force of the expander being transmitted thereto, and a slave-side magnet, provided outside of the housing, that undergoes slave rotation in accordance with the rotation of the driving-side magnet, in which the driving-side magnet and slave-side magnet are disposed with the partition wall therebetween and with different magnetic poles facing each other.

A reducer that reduces the rotation output by the driving unit and transmits that rotation to the magnetic coupling may be provided in a power transmission path from the driving unit of the expander to the driving-side magnet.

The driving-side magnet may be disposed so as to surround the outer circumference of the slave-side magnet with a distance provided therebetween, and two or more each of the driving-side magnet and slave-side magnet may be provided.

A first magnetic path formation member that magnetically connects the two or more driving-side magnets may be provided, and the first magnetic path formation member may be disposed so as to make contact with the driving-side magnets on the outer radial side of the magnetic coupling.

A second magnetic path formation member that magnetically connects the two or more slave-side magnets may be provided, and the second magnetic path formation member may be disposed so as to make contact with the slave-side magnets on the inner radial side of the magnetic coupling.

At least the part of the partition wall provided between the power transmission shaft divided on the inside and outside of the housing and that partitions the magnetic coupling on the inside and outside of the housing may be a nonmagnetic material.

The thermal engine may include, in a cyclic channel connected as a closed loop, an evaporator that evaporates a liquid working medium, the expander that rotates the driving unit by expanding the vapor of the working medium evaporated by the evaporator, a condenser that condenses the vapor of the working medium expanded by the expander and converts the working medium into liquid, and a circulation pump that circulates the working medium by pressure-transferring the liquid working medium condensed by the condenser to the evaporator.

According to the power generation apparatus of the present invention, rotational driving force generated by an expander can be extracted to the exterior of a housing that contains a driving unit of the expander while preventing a working fluid from leaking to the exterior of the housing even without using an integrated-type housing, a shaft sealing mechanism, or the like.

DESCRIPTION OF THE PREFERRED EMBODIMENTS

First Embodiment

Hereinafter, a first embodiment of a power generation apparatus 1 according to the present invention will be described based on the drawings.

Figure 1:
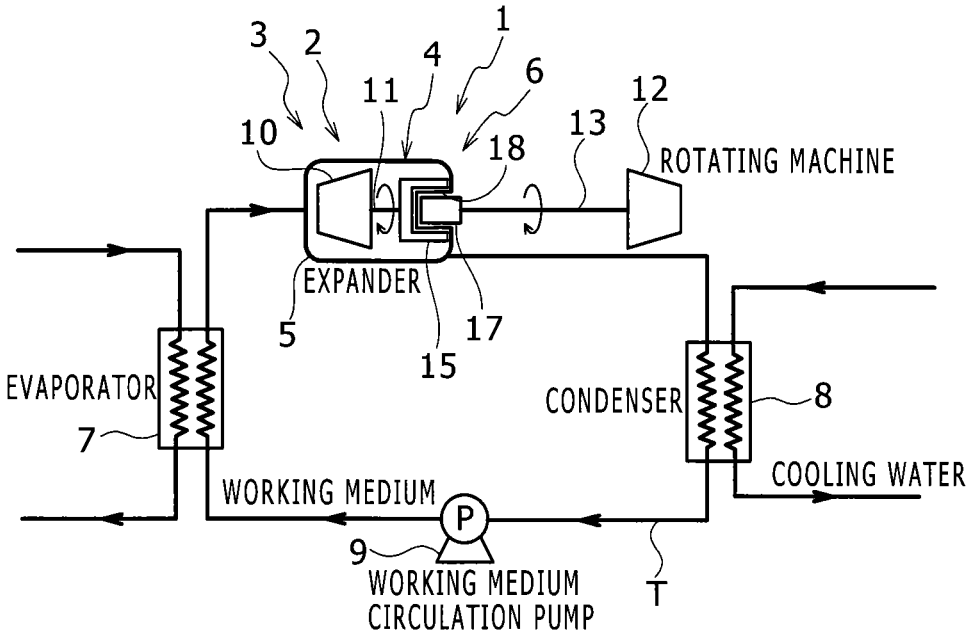
FIG. 1 is a diagram illustrating a power generation apparatus according to a first embodiment.

As shown in FIG. 1, the power generation apparatus 1 according to the first embodiment includes a thermal engine 3 having an expander 2 that includes a driving unit (a screw rotor 10, in the present embodiment) that is rotationally driven by the expansion of working fluid vapor, and a power transmission shaft that extracts the rotational driving force generated by the expander 2 to the exterior of a housing 4 that contains the driving unit 10 of the expander 2. The housing 4 contains the driving unit 10 of the expander 2 within a space enclosed by a partition wall 5 of the housing 4. The power transmission shaft is divided by the partition wall 5 into a drive shaft 11 located within the housing and a slave shaft 13 located outside of the housing. A magnetic coupling 6 is provided in the divided power transmission shaft, or in other words, in the drive shaft 11 and the slave shaft 13, in order to transmit the rotational driving force of the expander 2 to the exterior of the housing 4. Thus, the power generation apparatus 1 includes a power transmission apparatus configured of the power transmission shaft, which is configured of the drive shaft 11 and the slave shaft 13, and the magnetic coupling 6.

Note that in the first embodiment, a binary cycle is illustrated as an example of the thermal engine 3. That said, any engine may be included as the thermal engine 3 as long as it is an engine that converts heat into power. Steam engines, steam turbines, external combustion engines using a Stirling cycle, or internal combustion engines such as gas turbines are also included in addition to engines that use a Rankine cycle such as a binary cycle.

As shown in FIG. 1, the binary cycle includes, in a cyclic channel connected as a closed loop, an evaporator 7 that evaporates a liquid working medium T, the expander 2 that rotationally drives the driving unit by expanding the vapor of the working medium T evaporated by the evaporator 7, a condenser 8 that condenses the vapor of the working medium T expanded by the expander 2 and converts the working medium T into liquid, and a medium circulation pump 9 that circulates the working medium T by pressure-transferring the liquid working medium T condensed by the condenser 8 to the evaporator 7.

The expander 2 includes the screw rotor 10 (driving unit) that is rotationally driven by a pressure difference between the pre- and post-expansion vapor. The screw rotor 10 is capable of freely rotating about the drive shaft 11, and can transmit the generated rotational driving force via the drive shaft 11.

The housing 4 (partition wall 5) is provided around the screw rotor 10 (driving unit) of the expander 2, and the interior and exterior can be partitioned in an airtight state by the housing 4. The working medium T, which is a low-boiling point medium used in the binary cycle, is contained along with the screw rotor 10 within the housing 4 that is partitioned in an airtight state in this manner.

In the case where the rotational driving force produced by the screw rotor 10 of the expander 2 is to be transmitted to a rotating machine 12 (a compressor, a blower, or the like), it is normally necessary to provide a power transmission means capable of transmitting the rotational driving force between the expander 2 and the rotating machine 12.

Conventionally, in the case where a rotational shaft provided so as to pass through the interior/exterior of the expander housing is employed as the power transmission means, it is absolutely necessary to provide a shaft seal that suppresses the working medium from leaking from between the rotational shaft and the housing. Providing such a shaft seal is undesirable because it complicates the maintenance of the apparatus, leads to an increase in the running cost, and carries the risk of leaking of the working medium T that is contained. In order to solve this problem, the working medium T has conventionally been prevented from leaking by containing the expander and the rotating machine together within a single housing. If the expander and rotating machine are contained in an integrated-type housing in this manner, there are cases where the shaft seal is not needed between the two, but a specialized component then needs to be used as the rotating machine, which is undesirable because it leads to an increase in initial costs and because generic components cannot be used.

Accordingly, the power generation apparatus 1 according to the present invention includes the magnetic coupling 6 that transmits the rotational driving force of the expander 2 to the exterior of the housing 4 through the partition wall 5. In other words, to enable rotational driving force to be transmitted between the expander 2 and the rotating machine 12, the power generation apparatus 1 includes a power transmission apparatus configured of the power transmission shaft that is separated into the drive shaft 11 and the slave shaft 13 with the partition wall therebetween, and the magnetic coupling 6 that magnetically couples the two shafts that are separated between the interior and exterior of the housing with the partition walls therebetween.

Details of the power transmission apparatus will be given hereinafter.

Figure 2:
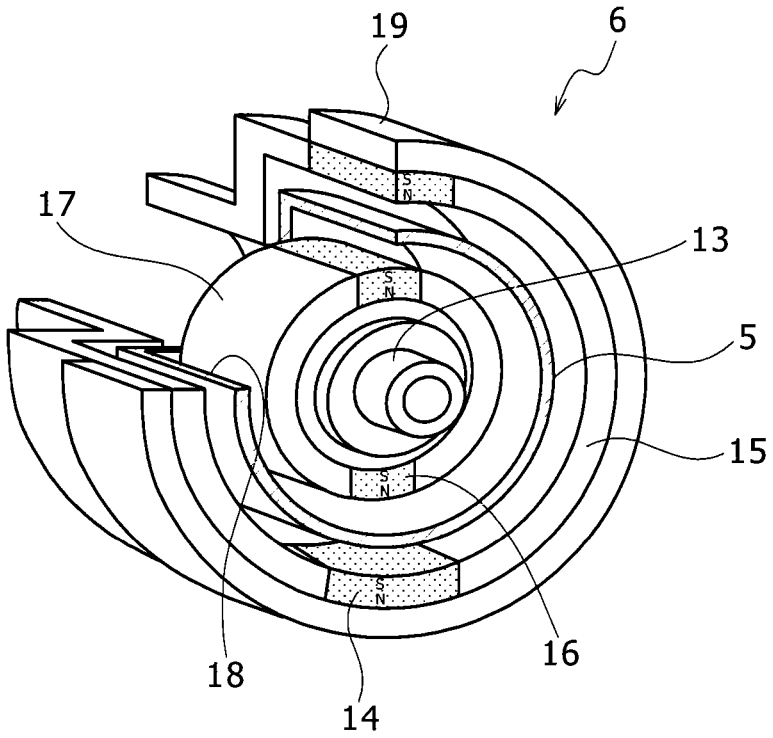
FIG. 2 is a perspective view illustrating a magnetic coupling provided in the power generation apparatus according to the first embodiment.

As shown in FIGS. 1 and 2, the drive shaft 11 is a rotational shaft disposed following the center of the rotational axis of the screw rotor 10 in the expander 2. One end of the drive shaft 11 (the left side, in FIG. 1) is coupled with the screw rotor 10, which serves as the driving unit of the expander 2, and the other end (the right side, in FIG. 1) extends to the vicinity of the partition wall 5. An outer cylinder 15 of the magnetic coupling 6, in which driving-side magnets 14 are mounted, is provided on the leading end of this other side.

The outer cylinder 15 is a closed-end cylindrical member that is open on the side that faces the rotating machine 12 (the side opposite to the screw rotor 10), and is formed of a nonmagnetic material. The drive shaft 11 is coupled coaxially with the outer cylinder 15, and the two driving-side magnets 14, which are disposed separated from each other in the circumferential direction, and provided opposite to each other in areas of the outer cylinder 15 formed in the cylindrical shape.

Meanwhile, the slave shaft 13 is a rotatable shaft disposed along the direction that is coaxial with the drive shaft 11. One end of the slave shaft 13 (the left side, in FIG. 1) extends toward the expander 2, and an insertion member 17 to which slave-side magnets 16 are attached is provided on this one end. The other end (the right side, in FIG. 1) is coupled with the rotating machine 12.

The insertion member 17 is a circular column-shaped member, and is, like the outer cylinder 15, formed of a nonmagnetic material. The insertion member 17 can be inserted into the outer cylinder 15 with a gap therebetween, and the slave-side magnets 16 are attached on the outer circumferential surface of the insertion member 17 (the outer circumferential surface of the portion that is inserted into the outer cylinder 15).

The partition wall 5 is present between the outer cylinder 15 and the insertion member 17, or in other words, between the driving-side magnets 14 and the slave-side magnets 16.

A recessed portion 18 that is open toward the outside and depressed toward the inside of the expander 2 is formed in the housing 4 in a position thereof that corresponds to the one end of the slave shaft 13 on which the insertion member 17 is provided, and this recessed portion 18 serves as the aforementioned partition wall 5.

In other words, the insertion member 17 fits into the recessed partition wall 5 (recessed portion 18) from the outside in a freely-rotatable state. Furthermore, when viewed from the interior of the housing 4, the recessed partition wall 5 is a circular column-shaped protrusion that protrudes toward the interior, and the outer cylinder 15 fits into the circular column-shaped protrusion. The inner diameter of the outer cylinder 15 is greater than the outer diameter of the partition wall 5, which corresponds to the circular column-shaped protrusion, and thus the outer cylinder 15 can freely rotate without making contact with the partition wall 5.

Although the driving-side magnets 14 and the slave-side magnets 16 are, in this example, permanent magnets such as neodymium magnets or samarium-cobalt magnets, it should be noted that electro-magnets may also be used.

Meanwhile, the driving-side magnets 14 and the slave-side magnets 16, two each of which are provided central to the axes in the circumferential directions of the outer cylinder 15 and the insertion member 17, respectively, are mounted with their N poles or S poles on the outer radial surface and the inner radial surface relative to the center of the rotational axis of the outer cylinder 15 so that magnetic field lines are emitted in the outer radial direction or the inner radial direction. The driving-side magnets 14 and the slave-side magnets 16 are disposed so that opposite poles are facing one another, so that magnetic pull is induced between the magnets through the partition wall 5.

Specifically, all of the magnets have their S poles located on the upper sides shown in FIG. 2 and their N poles located on the lower sides shown in FIG. 2; after traversing the magnets from the top to the bottom, the magnetic field lines are emitted in the outer radial direction from the N pole of the lowermost magnet (in the example shown, the N pole of the driving-side magnet 14) and travel upwards through the outer side of the magnets, converging on the S pole of the uppermost magnet (in the example shown, the S pole of the driving-side magnet 14) from the outer radial direction.

A first magnetic path formation member 19 that guides the magnetic field lines upward through the outer sides of the magnets without fail is provided on the outer circumferential side of the two driving-side magnets 14 mounted separate from each other in the circumferential direction.

Figure 3:
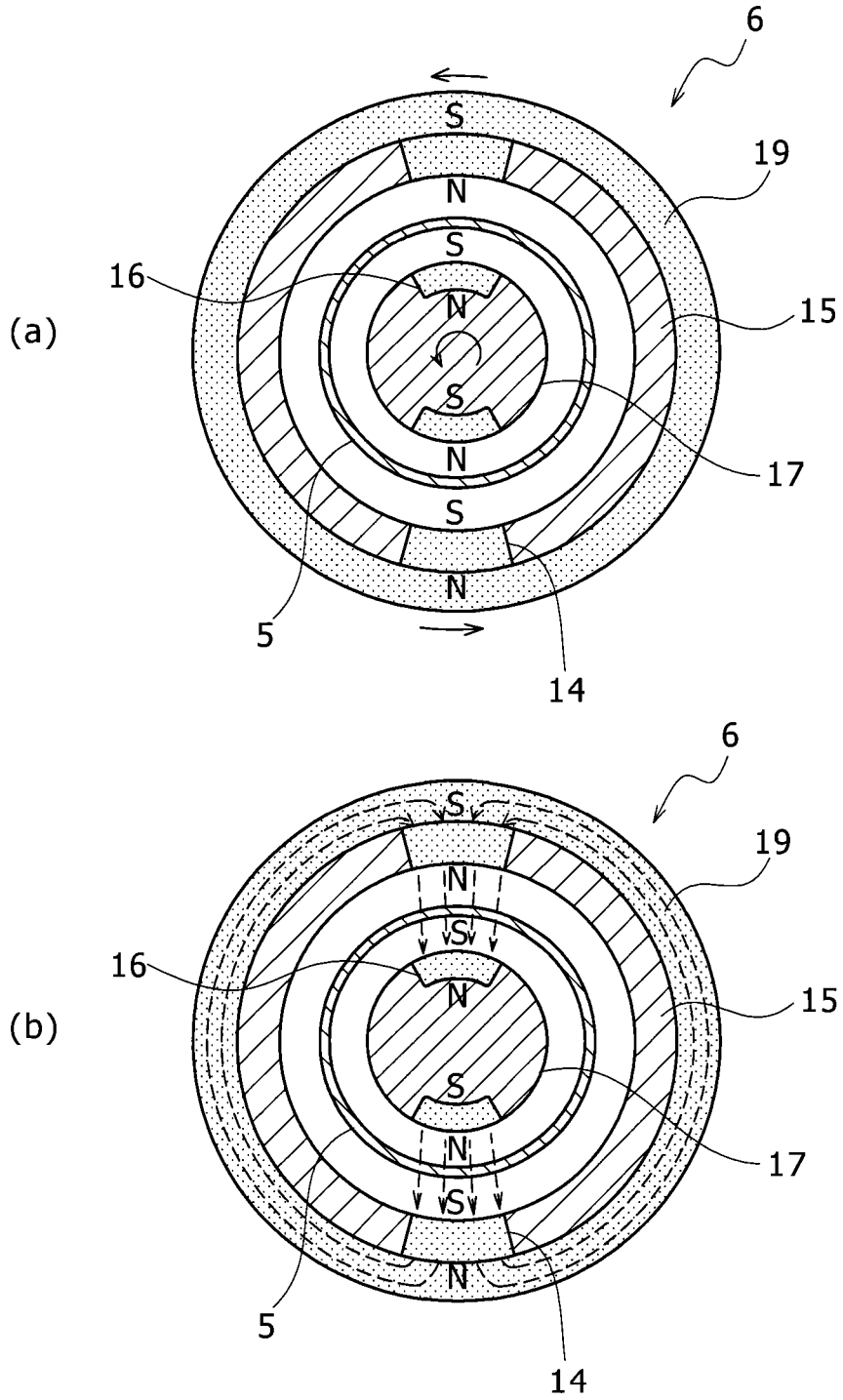
FIG. 3(*a*) is a cross-sectional view of the magnetic coupling according to the first embodiment, and FIG. 3(*b*) is a diagram illustrating the emission of magnetic field lines in the magnetic coupling.

As shown in FIG. 3(*a*), the first magnetic path formation member 19 that magnetically connects the driving-side magnets 14 to each other is a yoke in which a short cylinder is formed of a soft magnetic iron sheet so as to be capable of covering the entire circumference of the outer cylinder 15 from the outer circumferential side thereof. The first magnetic path formation member (hereinafter referred to as outer yoke) 19 makes contact with the stated two driving-side magnets 14 from the outer circumferential surfaces (magnetic poles) thereof. One of the outer circumferential surfaces of the two driving-side magnets 14 is an N pole, while the other outer circumferential surface is an S pole. Then, by guiding the magnetic field lines that have penetrated from the N pole of one of the two driving-side magnets 14 to the S pole of the other driving-side magnet 14, the outer yoke 19 suppresses magnetic field line leakage to the greatest extent possible and increases the magnetism of the driving-side magnets 14, which in turn provides an effect of increasing the torque transmitted to the slave-side magnets 16 from the driving-side magnets 14.

Using the power transmission apparatus as described above (the power transmission shaft and the magnetic coupling 6) makes it possible to transmit the rotational driving force (power) with the partition wall 5 present between the driving-side magnets 14 and the slave-side magnets 16.

Accordingly, it is not necessary to employ a means having various problems such as those employed in conventional apparatuses, or in other words, a means in which not only the expander but also the rotating machine that is rotated by the expander are contained within a single housing, a means in which a power transmission shaft that passes through the interior/exterior of the housing is provided and a shaft seal is provided for the shaft, or the like.

Furthermore, it is possible to efficiently extract (transmit) the rotational driving force generated by the expander 2 to the exterior of the housing 4 in which the driving unit of the expander 2 is contained while also preventing the working medium from leaking, without employing a means such as that described above. Note that if a means such as that described above is not employed, the maintenance of the apparatus is not complicated, and it is also possible to keep costs low.

Further, as shown in FIG. 3(*b*), providing the outer yoke 19 guides the magnetic field lines emitted from one of the driving-side magnets 14 to the other driving-side magnet 14 through the interior of the outer yoke 19. In other words, when the magnetic field lines penetrate into a magnetic material such as a magnetic path formation member (for example, the outer yoke 19), the magnetic field lines have a property whereby those magnetic field lines converge at an end of the magnetic path formation member, which is a magnetic material. Accordingly, if this property of the magnetic field lines is exploited, the magnetic pull between the driving-side magnets 14 and the slave-side magnets 16 can be increased by using the magnetic path formation member while also suppressing magnetic field line leakage to the greatest extent possible and increasing the magnetism of the driving-side magnets 14; this in turn increases the torque transmitted from the driving-side magnets 14 to the slave-side magnets 16 and makes it possible to efficiently transmit the rotational driving force.

Note that if the magnetism is increased by using the first magnetic path formation member (outer yoke 19) in this manner and increasing the number of driving-side magnets 14 or slave-side magnets 16, a high eddy current loss will occur at the partition wall 5 in the case where the partition wall 5 (housing 4) is made of a metal. However, because the eddy current loss can be reduced in accordance with the number of magnets used in the magnetic coupling 6, if the number of driving-side magnets 14 or slave-side magnets 16 that are provided is limited to two each, the eddy current loss can be suppressed to a low amount.

Second Embodiment

Next, a power generation apparatus 1 according to a second embodiment of the present invention will be described.

Figure 4:
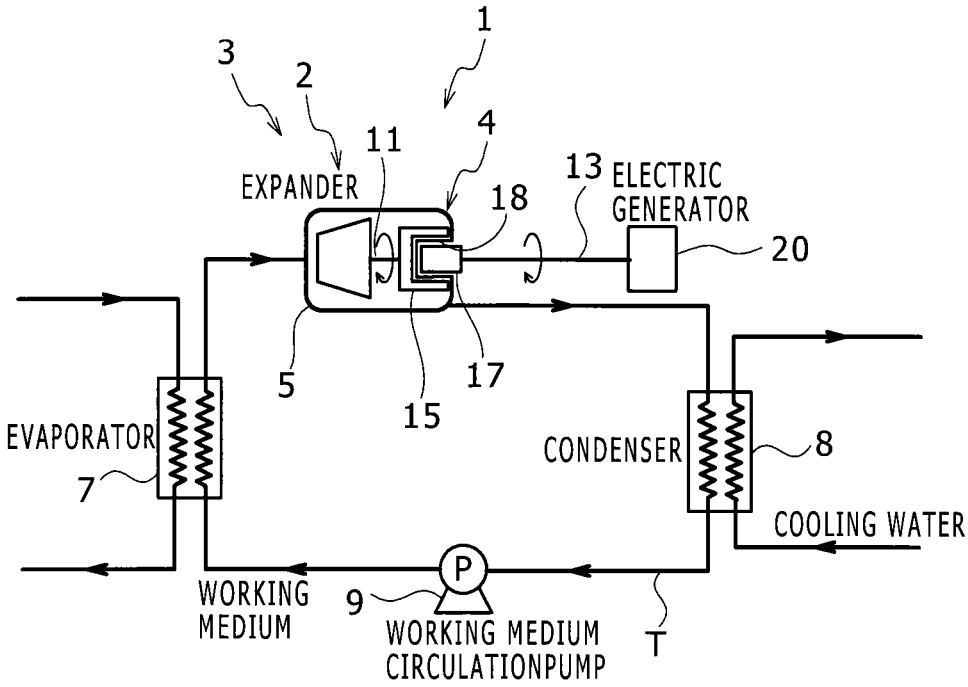
FIG. 4 is a diagram illustrating a power generation apparatus according to a second embodiment.

As shown in FIG. 4, the power generation apparatus 1 according to the second embodiment uses a binary cycle that generates electricity (a binary electric generation system). In other words, the power generation apparatus 1 transmits rotational driving force to the exterior of the housing 4 of the expander 2 using a power transmission apparatus that includes a driving transmission shaft that is divided between the inside and the outside of the housing (the drive shaft 11 and the slave shaft 13) and the magnetic coupling 6; an electric generator 20 is rotated using that rotational driving force, and thereby electricity is generated.

Although the first embodiment discloses a method for directly transmitting the rotational driving force to the rotating machine from the standpoint of the efficiency of power transmission, there are cases, depending on the equipment layout, where it is difficult to secure a space for providing a rotating machine such as a pump in the vicinity of the expander 2. In such a case, as illustrated in the second embodiment, it is preferable for electricity to be generated by the electric generator 20 using the rotational driving force transmitted to the exterior of the housing 4, the rotational driving force to be converted into electricity by the electric generator 20, and for the rotating machine 12 to then be driven by that electricity.

In the present embodiment as well, it is not necessary to provide a sealing mechanism and the like as employed in the conventional power transmission means, and the rotational power generated by the expander 2 can be efficiently extracted to the exterior of the housing 4 in which the expander 2 is contained while preventing the working medium from leaking. Furthermore, the maintenance of the apparatus is not complicated, and the running costs can be kept low.

Third Embodiment

Next, a power generation apparatus 1 according to a third embodiment of the present invention will be described.

The power generation apparatus 1 according to the first embodiment is an example in which a short cylinder-shaped member formed from a soft magnetic iron sheet (the outer yoke) is used as the first magnetic path formation member 19 in the magnetic coupling of the power transmission apparatus. On the other hand, in the third embodiment, the first magnetic path formation member 19 has "a configuration in which multiple magnetic shells 21 (plate-shaped magnets whose ends in the lengthwise direction are N poles or S poles) are arranged in an arc shape along the outer circumference of the outer cylinder 15 so as to be magnetically connected."

Figure 5:
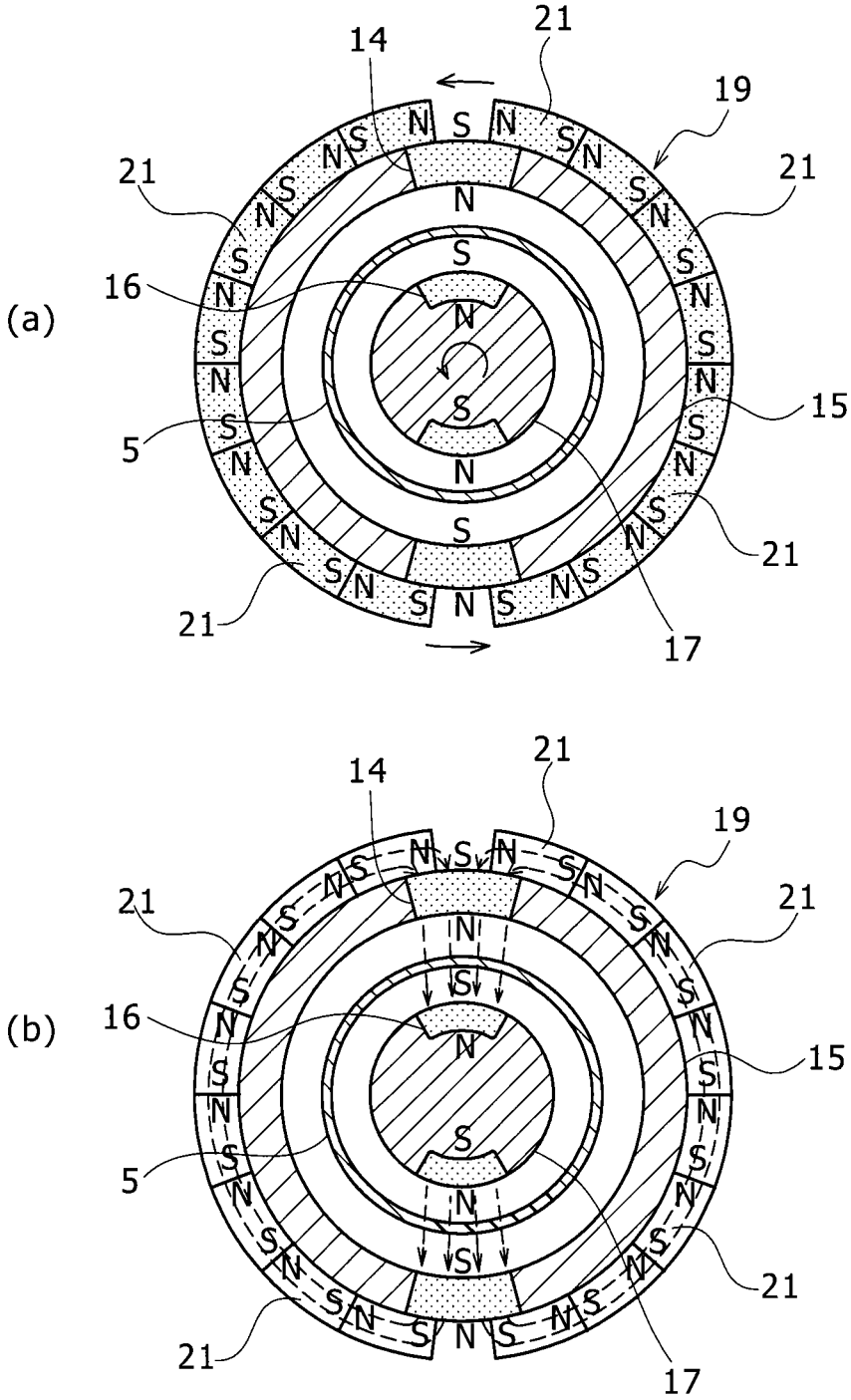
FIG. 5(*a*) is a cross-sectional view of a magnetic coupling according to a third embodiment, and FIG. 5(*b*) is a diagram illustrating the emission of magnetic field lines in the magnetic coupling.

Specifically, as shown in FIG. 5(*a*), the first magnetic path formation member 19 according to the third embodiment has multiple (in the example shown here, 16) magnetic shells 21 arranged in the circumferential direction along the outer circumferential surface of the outer cylinder 15. These magnetic shells 21 are curved in an arc shape that follows the outer circumferential surface of the outer cylinder 15. Two of the magnetic shells 21 are disposed so as to make contact with the S-pole surface of the driving-side magnet 14 on the upper side in FIGS. 5(*a*) and 5(*b*), on the left and right sides of that S-pole surface. These magnetic shells 21 are disposed so that their N poles are facing each other, and are disposed at a distance from each other in the circumferential direction so as not to come in contact with each other.

Meanwhile, two of the magnetic shells 21 are also disposed so as to make contact with the N-pole surface of the driving-side magnet 14 on the lower side in FIGS. 5(*a*) and 5(*b*), on the left and right sides of that N-pole surface. These magnetic shells 21 are disposed so that their S poles are facing each other and are disposed at a distance from each other. Eight magnetic shells 21 are disposed on the left side and eight magnetic shells 21 are disposed on the right side so that interpolation occurs between the two magnetic shells 21 disposed so as to come into contact with the upper driving-side magnet 14 and the two magnetic shells 21 disposed so as to come into contact with the lower driving-side magnet 14. Adjacent magnetic shells 21 are disposed so that opposite magnetic poles are facing each other.

As shown in FIG. 5(*b*), even if a magnetic path formation member 19 that includes a combination of multiple magnetic shells 21 is used instead of the outer yoke configured from a soft magnetic iron sheet, the multiple magnetic shells 21 can form a magnetic field line path (magnetic circuit), and the magnetic field lines are transmitted in order through the interior thereof. Thus, it is possible to increase the magnetism of the driving-side magnet 14, which in turn increases the torque transmitted from the driving-side rotational shaft to the slave-side rotational shaft and makes it possible to efficiently transmit the rotational driving force.

Fourth Embodiment

Next, a power generation apparatus 1 according to a fourth embodiment of the present invention will be described.

Figure 6:
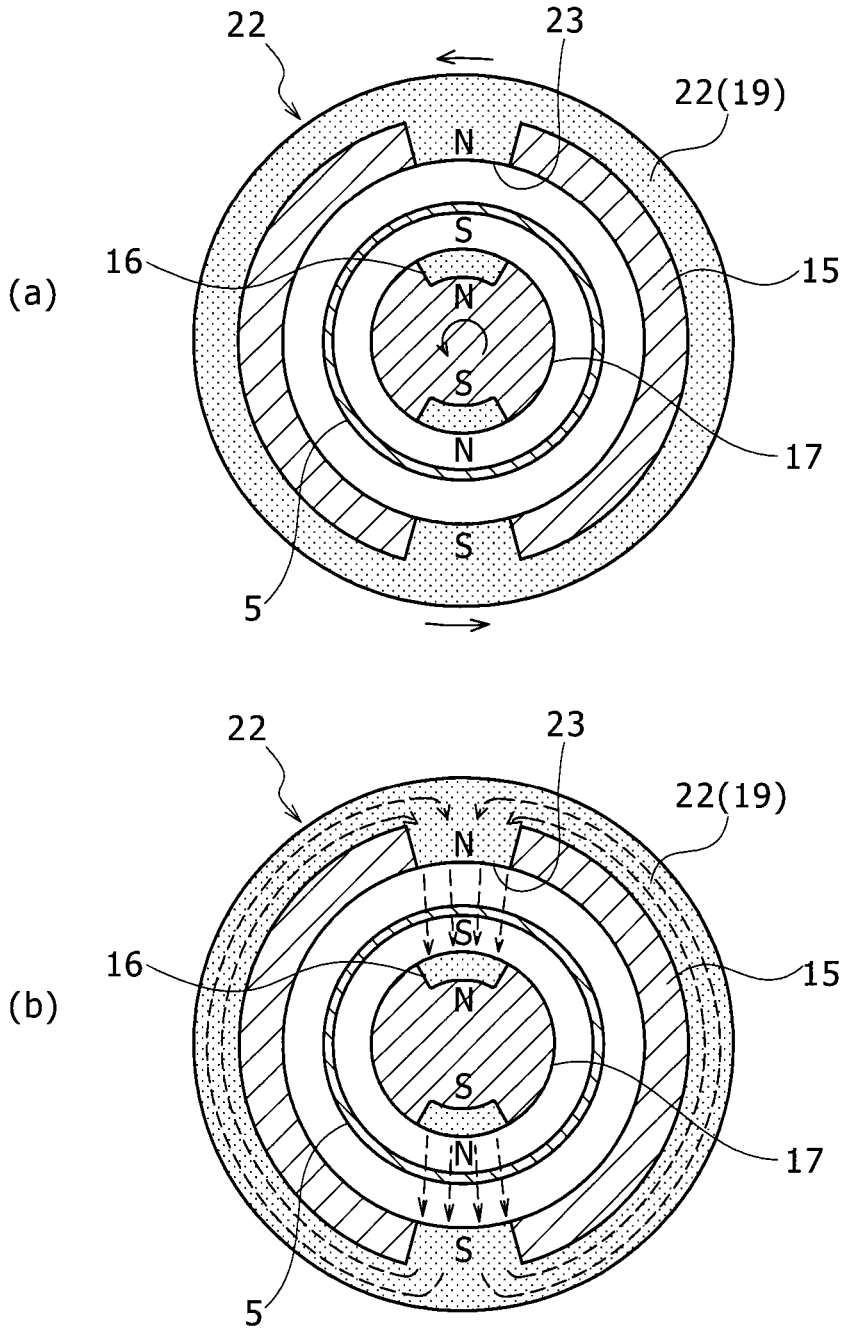
FIG. 6(*a*) is a cross-sectional view of a magnetic coupling according to a fourth embodiment, and FIG. 6(*b*) is a diagram illustrating the emission of magnetic field lines in the magnetic coupling.

As shown in FIG. 6(*a*), the power generation apparatus 1 according to the fourth embodiment uses, for the magnetic coupling in the power transmission apparatus, an entity in which the first magnetic path formation member (outer yoke) 19 according to the stated first embodiment and the driving-side magnets 14 are integrated as a single entity. In other words, a magnet (hereinafter referred to as integrated magnet 22) that provides the functions of both the driving-side magnets 14 and the first magnetic path formation member 19 is included.

The integrated magnet 22 is a cylindrical member that covers the entire outer circumferential surface of the outer cylinder 15, and is provided with protruding portions 23 that protrude in the inner radial direction and correspond to the driving-side magnets 14 in the third embodiment; the leading end of one of the protruding portions 23 (on the lower side, in FIG. 6(*a*)) serves as the N pole, while the leading end of the other protruding portion 23 (on the upper side, in FIG. 6(*a*)) serves as the S pole.

As shown in FIG. 6(*b*), even if the integrated magnet 22 that provides the functions of both the first magnetic path formation member 19 and the driving-side magnets 14 is used, the magnetic field lines are transmitted from the N pole to the S pole through the interior of the integrated magnet 22, and thus the magnetism of the driving-side magnets 14 can be increased; this in turn increases the torque transmitted from the driving-side rotational shaft to the slave-side rotational shaft and makes it possible to efficiently transmit the rotational driving force.

Fifth Embodiment

Next, a power generation apparatus 1 according to a fifth embodiment of the present invention will be described.

In the present embodiment, the configuration is such that a second magnetic path formation member 24 configured of a soft magnetic iron sheet, multiple magnetic shells 21, or the integrated magnet 22 is provided on the insertion member 17 of the power transmission apparatus (the leading end of the slave shaft 13) and the slave-side magnets 16 are connected to each other; the other configurations are essentially the same as in the aforementioned embodiments.

Figure 7:
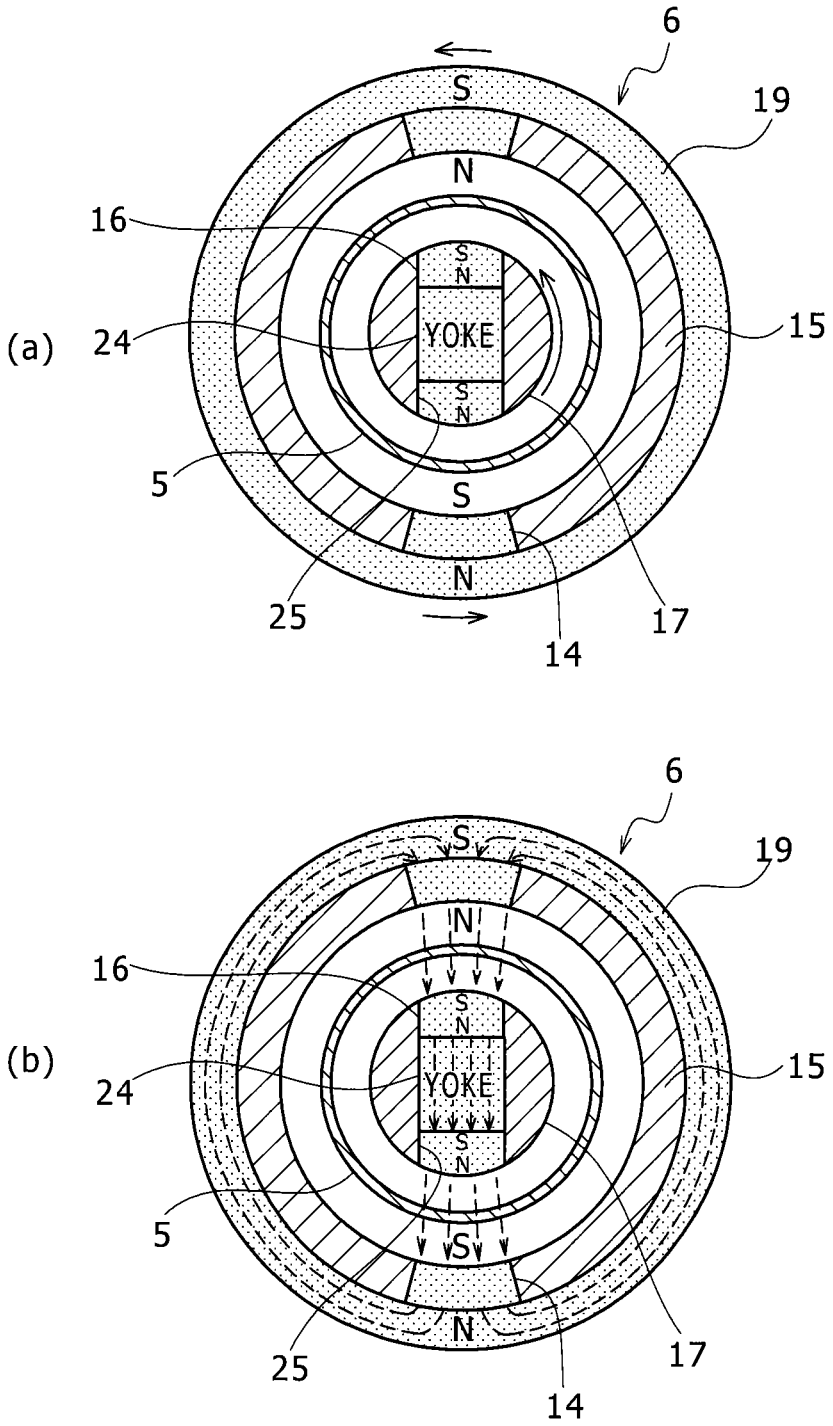
FIG. 7(*a*) is a cross-sectional view of a magnetic coupling according to a fifth embodiment, and FIG. 7(*b*) is a diagram illustrating the emission of magnetic field lines in the magnetic coupling.

Specifically, as shown in FIG. 7(*a*), the power transmission apparatus according to the fifth embodiment is provided with the second magnetic path formation member 24 that magnetically connects two or more slave-side magnets 16 to each other. The second magnetic path formation member 24 is disposed in a hole or a groove provided so as to pass through the insertion member 17 (the slave shaft 13) orthogonal to the axial direction.

Specifically, the slave-side magnets 16 are provided in two locations in the outer circumferential surface of the insertion member 17, or the upper side and lower side in FIGS. 7(*a*) and 7(*b*), with the center of the rotational axis of the insertion member 17 located therebetween. The second magnetic path formation member 24 that magnetically connects the two slave-side magnets 16 is disposed between the two upper and lower slave-side magnets 16. The second magnetic path formation member 24 is, like the yoke that serves as the first magnetic path formation member 19, a yoke formed of a soft magnetic iron sheet. The second magnetic path formation member 24 is contained within a through-hole 25 that passes through the insertion member 17 from top to bottom (in the vertical direction relative to the axis); the upper surface thereof makes contact with the N pole of the upper slave-side magnet 16, while the lower surface thereof makes contact with the S pole of the lower slave-side magnet 16.

Therefore, as shown in FIG. 7(*b*), magnetic field lines are formed from the N pole of the upper slave-side magnet 16 to the S pole of the lower slave-side magnet 16 and passing through the interior of the second magnetic path formation member 24, and the magnetic field line leakage to the exterior is reduced. Thus, it is possible to increase the magnetism of the slave-side magnets 16, which in turn increases the torque transmitted from the driving-side magnets 14 to the slave-side magnets 16 and makes it possible to efficiently transmit the rotational driving force.

Sixth Embodiment, Seventh Embodiment

Like the first magnetic path formation member 19 used in the other stated embodiments to increase the magnetism of the driving-side magnets 14, the second magnetic path formation member 24 can be combined with multiple magnetic shells 26, or an integrated magnet 27 can be configured from the slave-side magnets 16 and the second magnetic path formation member 24.

Figure 8:
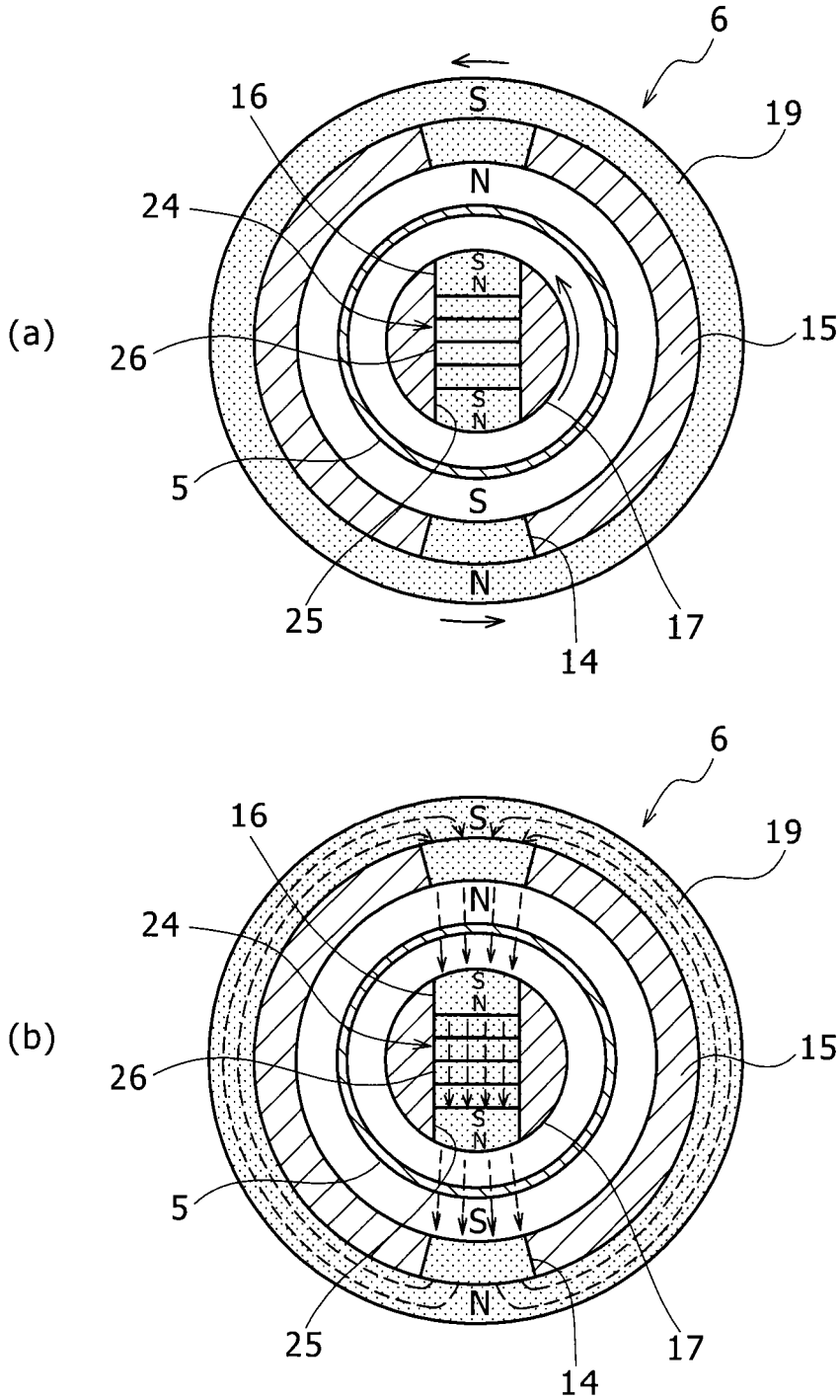
FIG. 8(*a*) is a cross-sectional view of a magnetic coupling according to a sixth embodiment, and FIG. 8(*b*) is a diagram illustrating the emission of magnetic field lines in the magnetic coupling.

For example, as shown in FIG. 8(*a*), the power transmission apparatus according to a sixth embodiment of the present invention employs a stack of multiple magnetic shells 26 as the second magnetic path formation member 24 instead of a soft magnetic iron sheet. Even if the second magnetic path formation member 24 shown in FIG. 8(*a*) is used, the magnetism of the slave-side magnets 16 can be increased through the interior of the multiple magnetic shells 26 (the second magnetic path formation member 24) as shown in FIG. 8(*b*).

Figure 9:
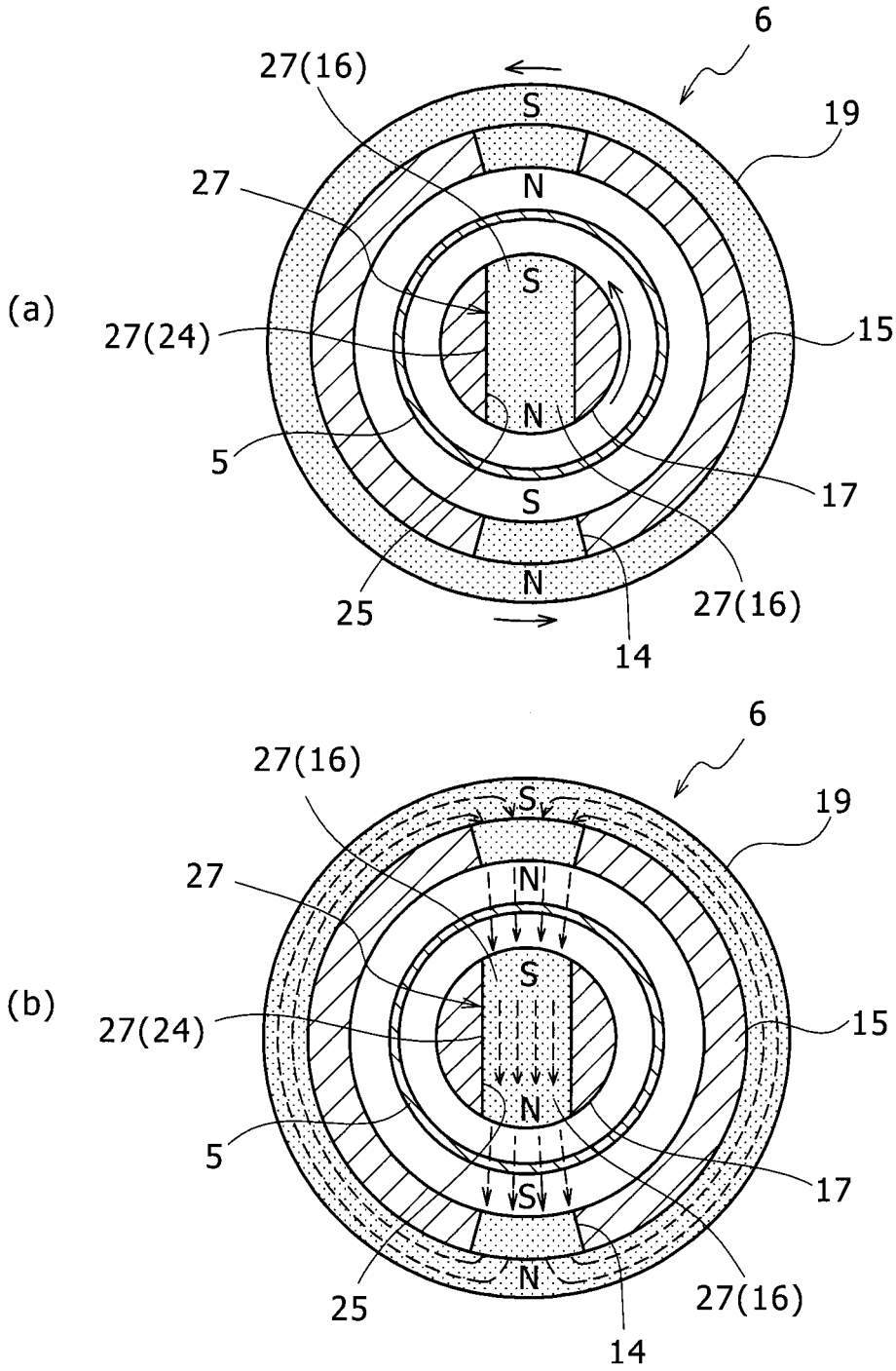
FIG. 9(*a*) is a cross-sectional view of a magnetic coupling according to a seventh embodiment, and FIG. 9(*b*) is a diagram illustrating the emission of magnetic field lines in the magnetic coupling.

Meanwhile, as shown in FIG. 9(*a*), the power transmission apparatus according to a seventh embodiment of the present invention uses the integrated magnet 27 in which the second magnetic path formation member 24 and two upper and lower slave-side magnets 16 are a single entity. Even if the integrated magnet 27 (the second magnetic path formation member 24) shown in FIG. 9(*a*) is used, the magnetism of the slave-side magnets 16 can be increased through the interior of the integrated magnet 27 (the second magnetic path formation member 24) as shown in FIG. 9(*b*), which increases the torque transmitted from the driving-side magnets 14 to the slave-side magnets 16 and makes it possible to efficiently transmit the rotational driving force.

Note that although not shown in the drawings, the configurations of the second magnetic path formation member 24 according to the fifth through seventh embodiments described above are not limited to the first magnetic path formation member 19 described in the first embodiment. That is, there are no problems in combining the configurations of the second magnetic path formation member 24 according to the fifth through seventh embodiments with the first magnetic path formation member 19 according to one of the second through fourth embodiments.

Eighth Embodiment

Next, a power generation apparatus 1 according to an eighth embodiment of the present invention will be described.

Figure 10:
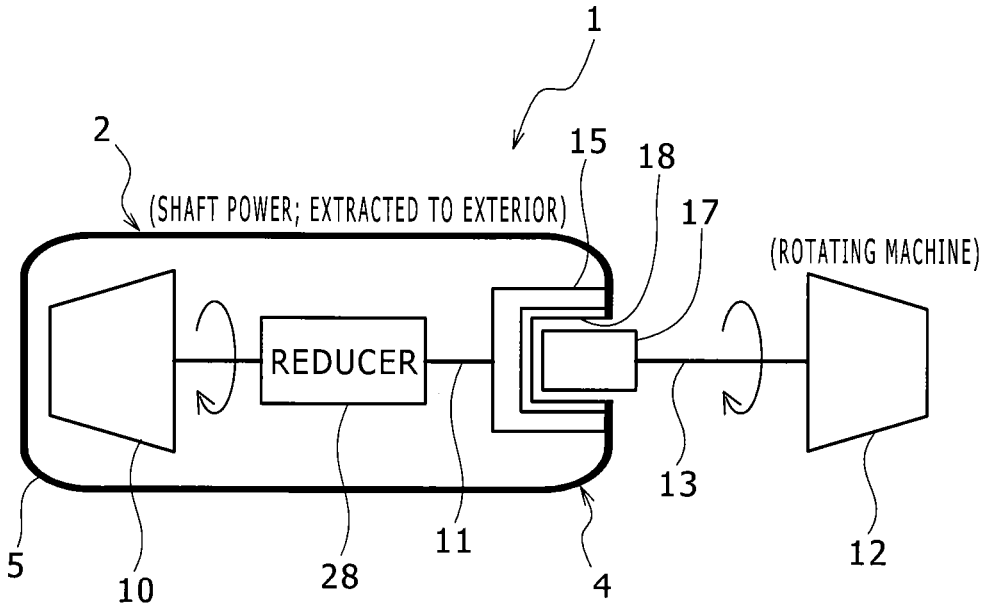
FIG. 10 is a diagram illustrating the primary elements of a power generation apparatus according to an eighth embodiment.

As shown in FIG. 10, in the power generation apparatus 1 according to the eighth embodiment, a reducer 28 that reduces the rotational driving force from the expander 2 and transmits that force to the magnetic coupling 6 is provided in the power transmission path from the expander 2 to the driving-side magnets 14.

The reducer 28 is provided between the driving unit of the expander 2, or the drive shaft 11 provided within the housing 4, and the outer cylinder 15 (the driving-side magnets 14). The reducer 28 enables the rotational velocity produced by the expander 2 to be transmitted to the magnetic coupling 6 in a reduced state, which makes it possible to adjust, in advance, a rotational frequency of the drive shaft 11 to a rotational frequency suited to the usage range of the rotating machine 12, which is, for example, a pump, a compressor, or the like.

Note that the descriptions disclosed in the above embodiment are to be understood as being in all ways exemplary and in no way limiting. In particular, items that are not explicitly disclosed in the embodiments disclosed above, such as operating conditions, working conditions, various types of parameters, the dimensions, weights, volumes, and so on of constituent elements, and the like use values that can easily be assumed by one skilled in the art without departing from the scope that one skilled in the art normally works within.

Although the stated first through eighth embodiments describe the magnetic coupling 6 as having a structure in which the insertion member 17 provided on the slave shaft 13 is inserted into the interior of the outer cylinder 15 provided in the drive shaft 11, it should be noted that which of the outer cylinder 15 and insertion member 17 is to be used as the driving side (or slave side) can be selected as desired. For example, a magnetic coupling 6 having a structure in which the insertion member 17 provided on the drive shaft 11 is inserted into the outer cylinder 15 provided on the slave shaft 13 may be used.

Furthermore, although the stated first through eighth embodiments describe examples in which two each of the driving-side magnets 14 and the slave-side magnets 16 are provided in order to reduce eddy current loss, the magnets are not limited to two each. For example, a configuration in which four to eight each of the driving-side magnets 14 and the slave-side magnets 16 may be used.

Further, a nonmagnetic material such as a ceramic, glass, a glass fiber, carbon fiber, or the like can be used as the material of the partition wall 5 in the housing 4. In such a case, it is not necessary to take eddy current loss into consideration, and thus two or more driving-side magnets 14 and slave-side magnets 16 each may be provided; however, in the case where the partition wall is to be made thicker (the case where a slight distance is provided between the driving-side magnets 14 and the slave-side magnets 16), it is desirable to employ two magnets each.

What is claimed is:

1. A power generation apparatus comprising:

a thermal engine including an expander comprising a driving unit and a housing comprising a partition wall that defines a housing space that contains the driving unit; and a power transmission shaft that extracts rotational driving force generated by the expander to the exterior of the housing space that contains the driving unit of the expander, wherein the power transmission shaft rotates with a part of a magnetic coupling for transmitting the rotational driving force from the expander to the exterior of the housing space, the magnetic coupling being divided between the interior and exterior of the housing space through a portion of the partition wall, wherein the magnetic coupling includes at least two driving-side magnets that rotate on the inside of the housing space due to the rotational driving force of the expander being transmitted thereto, and at least two slave-side magnets provided outside of the housing space, and at the part of the magnetic coupling with which the power transmission shaft rotates, the at least two slave-side magnets undergoing slave rotation in accordance with the rotation of the driving-side magnets, wherein the driving-side magnets and slave-side magnets are disposed with the portion of the partition wall therebetween and with different magnetic poles facing each other, and the driving-side magnets are disposed so as to surround the outer circumference of the slave-side magnets with a distance provided therebetween, further comprising:

a first magnetic path formation member formed of a magnetically permeable material and that magnetically connects the at least two driving-side magnets, and the first magnetic path formation member being disposed so as to make contact with the driving-side magnets on the outer radial side of the magnetic coupling; and a second magnetic path formation member formed of a magnetically permeable material and that magnetically connects the at least two slave-side magnets, the second magnetic path formation member being disposed entirely within a through hole that passes through the part of the magnetic coupling with which the power transmission shaft rotates, and in a radial direction transverse to the rotation axis, so as to make contact with the slave-side magnets.

2. The power generation apparatus according to claim 1, wherein an electric generator that generates electricity using the rotational driving force transmitted to the exterior of the housing space is connected to the power transmission shaft on the outside of the housing space.

3. The power generation apparatus according to claim 1, wherein a reducer that reduces the rotation output by the driving unit and transmits that rotation to the magnetic coupling is provided in a power transmission path from the driving unit of the expander to the driving-side magnet.

4. The power generation apparatus according to claim 1, wherein at least the portion of the partition wall is formed of a nonmagnetic material.

5. The power generation apparatus according to claim 1, wherein the thermal engine comprises a closed loop including an evaporator that evaporates a liquid working fluid, the expander that rotates the driving unit by expanding the vapor of the working fluid evaporated by the evaporator, a condenser that condenses the vapor of the working fluid expanded by the expander and converts the working fluid into liquid, and a circulation pump that circulates the working fluid by pressure-transferring the liquid working fluid condensed by the condenser to the evaporator.

6. The power generation apparatus according to claim 1, wherein the magnetic coupling comprises exactly two driving-side magnets and exactly two slave-side magnets.

* * * * *